United States Patent [19]

Maiocco

[11] 4,360,717

[45] Nov. 23, 1982

[54] ANTITHEFT DEVICE FOR MOTOR VEHICLES COMPRISING AN IGNITION AND STARTING SWITCH

[75] Inventor: Guiseppe Maiocco, Rivoli, Italy

[73] Assignee: Arman S.p.A., Druento, Italy

[21] Appl. No.: 153,679

[22] Filed: May 27, 1980

[30] Foreign Application Priority Data

Jun. 15, 1979 [IT] Italy ..... 68285 A/79

[51] Int. Cl.[3] ..... H01H 21/18; H01H 15/00; H01H 27/00

[52] U.S. Cl. ..... 200/11 C; 200/11 EA; 200/16 C; 200/44

[58] Field of Search ..... 200/11 R, 11 A, 11 C, 200/11 EA, 11 G, 11 J, 11 K, 16 C, 16 F, 44, 277, 8 R, 8 A

[56] References Cited

U.S. PATENT DOCUMENTS

| | | | |
|---|---|---|---|
| 2,203,949 | 6/1940 | Edwards . | |
| 2,348,134 | 5/1944 | Jacobi | 200/44 |
| 3,527,071 | 9/1970 | Warnod . | |
| 3,643,043 | 2/1972 | Endow | 200/16 F |
| 3,686,449 | 8/1972 | Black et al. | 200/11 C |
| 3,840,714 | 10/1974 | Arman . | |
| 3,914,967 | 10/1975 | Arman . | |
| 3,974,348 | 8/1976 | Lipschutz | 200/11 C X |

FOREIGN PATENT DOCUMENTS

| | | | |
|---|---|---|---|
| 1538745 | 1/1979 | United Kingdom | 200/11 J |

*Primary Examiner*—James R. Scott
*Attorney, Agent, or Firm*—John C. Purdue

[57] ABSTRACT

A motor vehicle power switch is provided and, in the form illustrated, is for use in conjunction with an automotive antitheft device. The antitheft device has apparatus for engaging a latch in a notch in the steering column to prevent turning of the steering column when the device is operative. A key operates the apparatus which moves a slider with respect to a stator. The slider has a plurality of conductive rollers which are urged toward the stator and at appropriate locations sequentially connects a main contact with secondary fixed contacts. The fixed contacts may be connected to the coil, the service mechanism, the fuel pump, to the starter. Specially designed sections are provided on the stator to facilitate rapid and positive closure of the electrical contacts.

7 Claims, 17 Drawing Figures

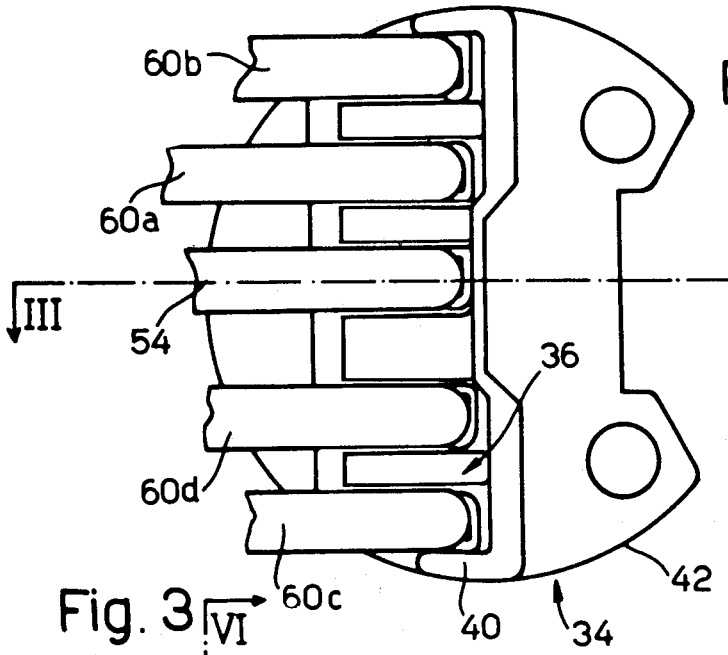
Fig. 2
Fig. 3
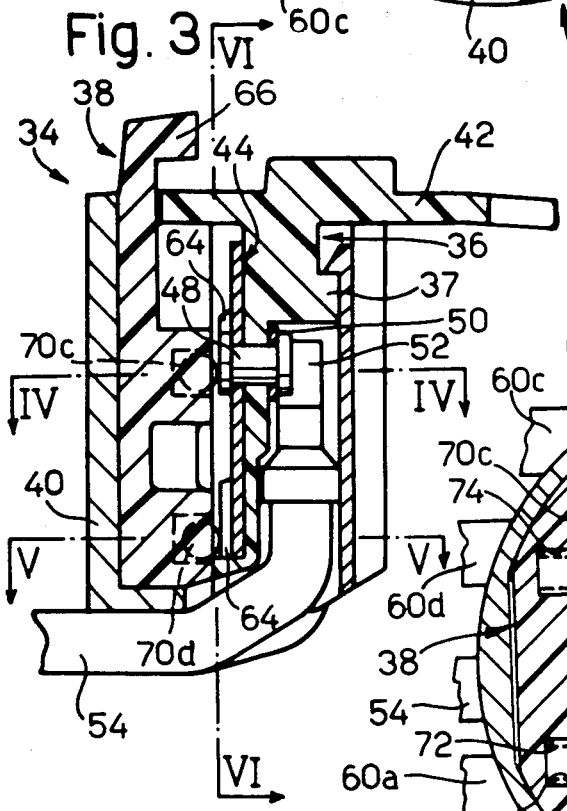
Fig. 4
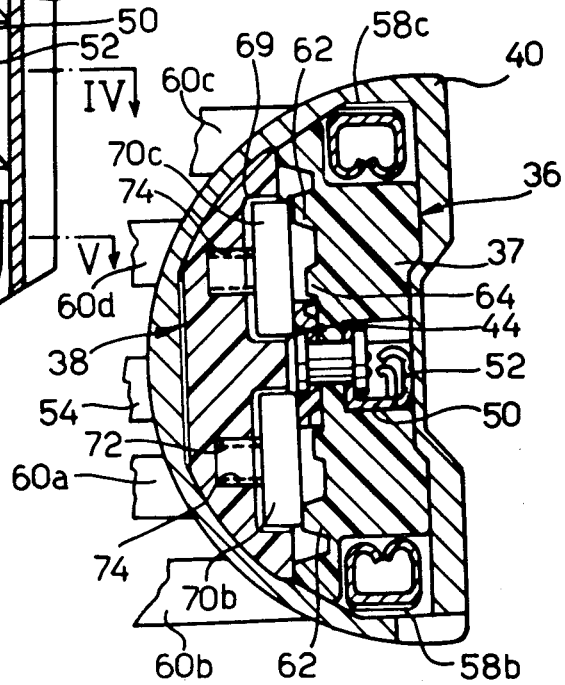

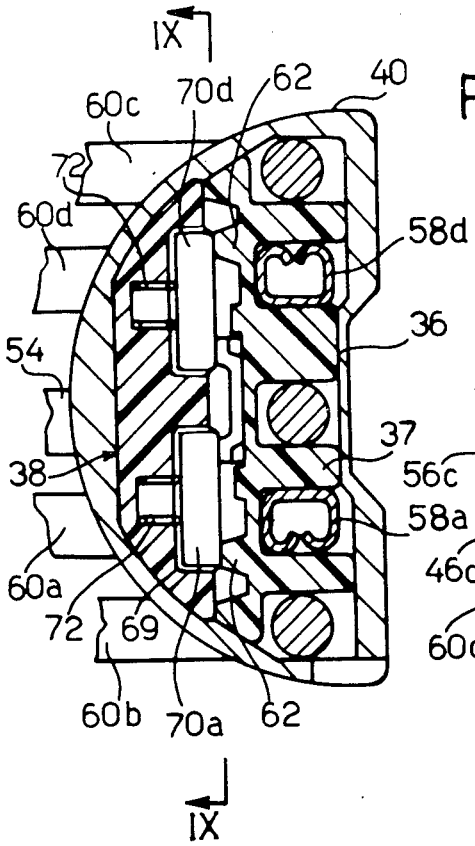
Fig. 5
Fig. 7
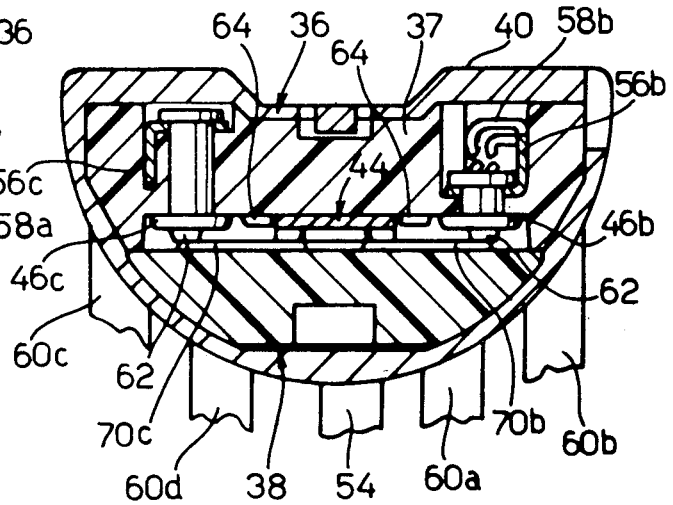
Fig. 6
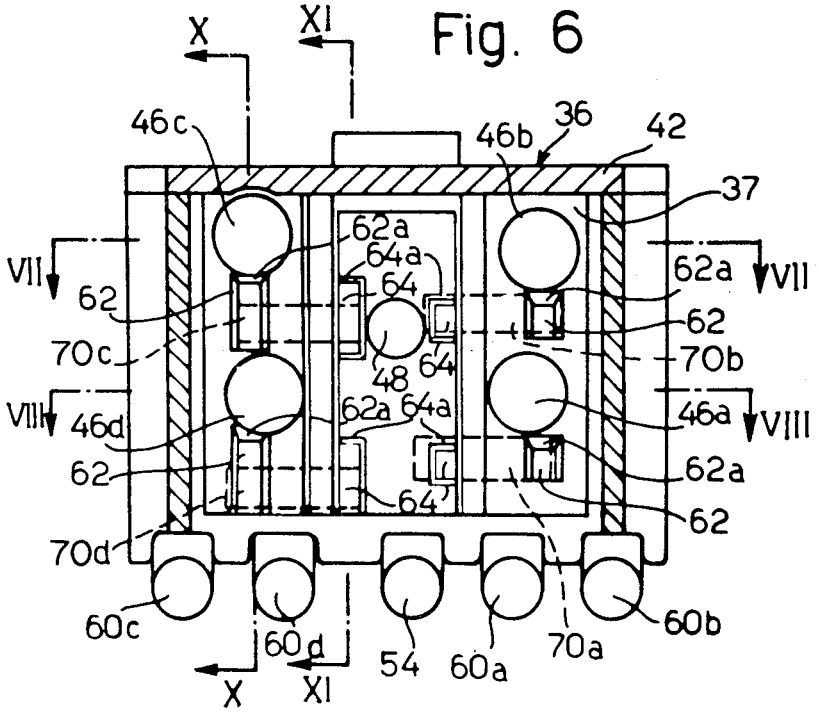

ANTITHEFT DEVICE FOR MOTOR VEHICLES COMPRISING AN IGNITION AND STARTING SWITCH

BACKGROUND OF THE INVENTION

1. Field of the Invention

The present invention relates to a motor vehicle power switch and, more particularly, to a power switch having a key-actuated rotatable cylinder for sequential connection of various motor vehicle circuits, such as the coil, fuel pump, and starter to a power source.

2. Description of the Prior Art

Antitheft devices for motor vehicles are fairly well-known and are mounted on the steering housing of the vehicle. The device has a lock cylinder and latch mounted on the steering housing in a way that the latch engages in a recess in the steering column to prevent turning of the steering column. With a key in the lock cylinder, the latch can be retracted from the recess and the engine and accessories on the vehicle can be energized.

Heretofore, the antitheft devices had power switches so that as the latch is being disengaged from the steering column, various sequential electrical connections are made to parts of the vehicle for starting the vehicle and the like.

One such device is shown and described in my issued U.S. Pat. No. 3,914,967, issued Oct. 28, 1975, and has radial pushers acting on basculating contacts, each of the contacts cooperating with a pair of contact tablets connected to the motor vehicle electrical system. The prior motor vehicle power switches have typically been complex, costly, and bulky.

SUMMARY OF THE INVENTION

It is therefore a feature of the present invention to provide a motor vehicle power switch which is particularly simple, functional, economical and greatly reduced in size.

The motor vehicle power switch of the present invention includes a stator having a main fixed contact and a plurality of secondary fixed contacts secured thereto. The main fixed contact is connected to the power source; the secondary fixed contacts being positioned in pairs on both sides of the main fixed contact and connected to various motor vehicle circuits.

The switch also includes a slider which provides axial movement upon rotation of the key-actuated cylinder. A plurality of conductive rollers are secured to the slider and are urged toward the stator by helical springs for engagement with the fixed contacts.

The stator is further provided with raised and lowered sections engaged by the conductive rollers for sequential connection of the main fixed contact to the secondary fixed contacts. The raised and lowered sections are connected by sharply inclined surfaces, providing rapid closure of the contacts so as to prevent arcing.

Other characteristics and advantages of the invention will be more fully understood when reading the following portions of the specification in conjunction with the accompanying drawings.

BRIEF DESCRIPTION OF THE DRAWINGS

FIG. 2 is a bottom view of the switch according to the invention;

FIG. 3 is a longitudinal section along the line III—III of FIG. 2 showing the switch in its initial rest position;

FIG. 4 is a cross section along the line IV—IV of FIG. 3;

FIG. 5 is a cross section along the line V—V of FIG. 3;

FIG. 6 is a longitudinal section along the line VI—VI of FIG. 3;

FIG. 7 is a cross section along the line VII—VII of FIG. 6;

DETAILED DESCRIPTION OF THE INVENTION

Figure 1:
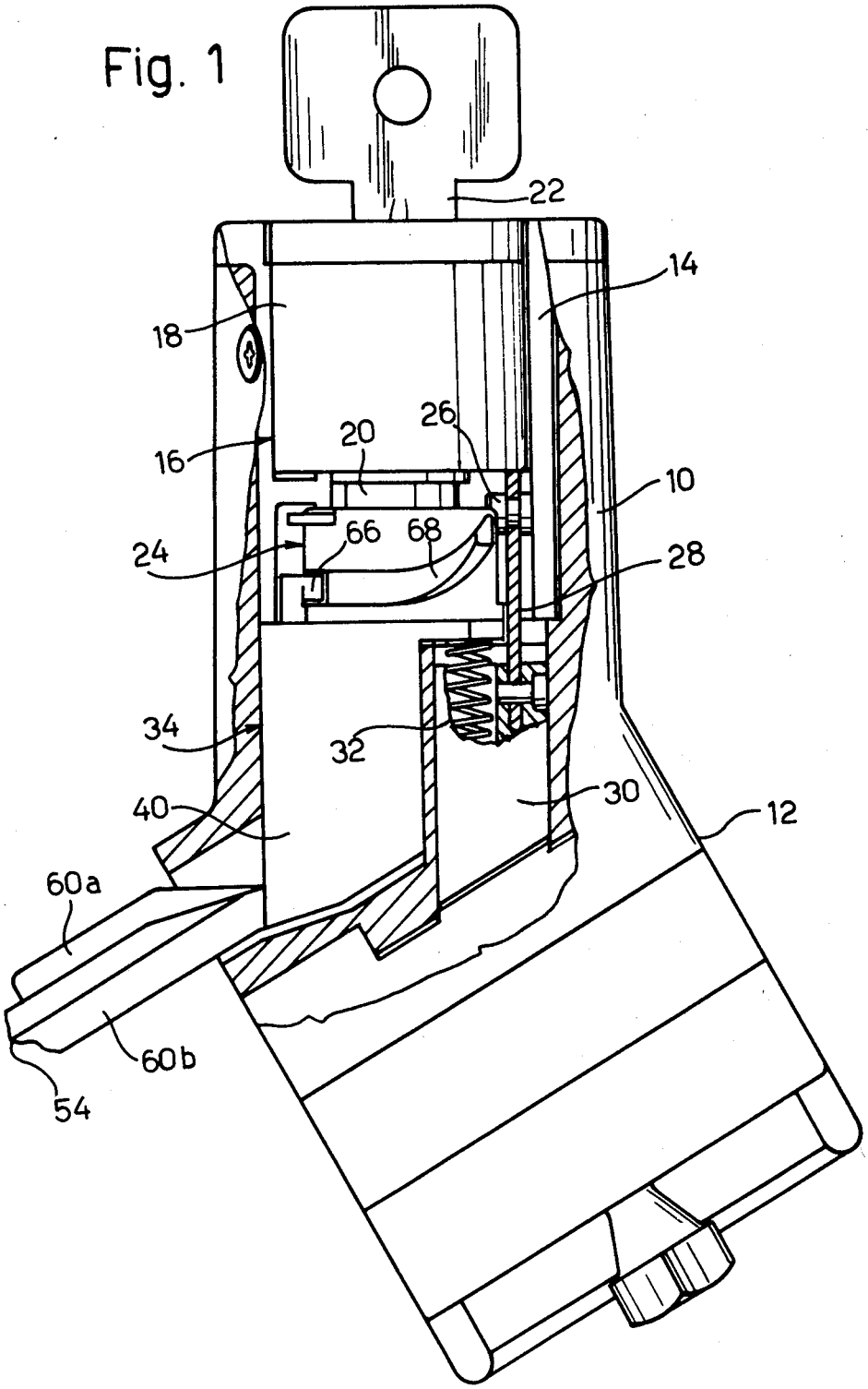
FIG. 1 is a schematic view, partially in longitudinal section, of an antitheft device for motor vehicles comprising an ignition and starting switch.
Figure 8:
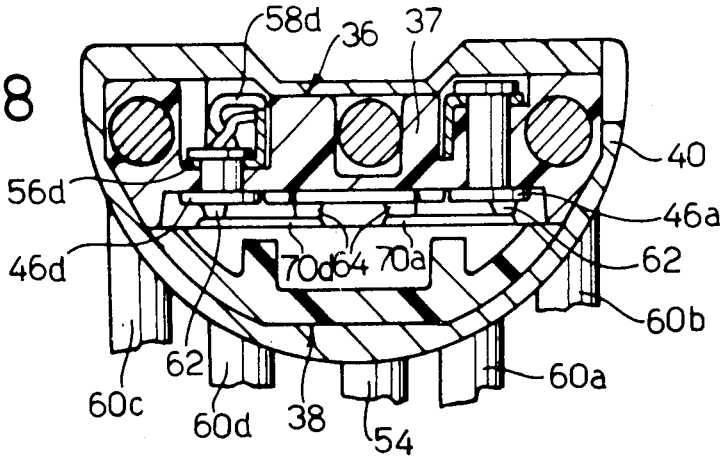
FIG. 8 is a cross section along the line VIII—VIII of FIG. 6.

With reference to FIG. 1, an antitheft device for locking the steering shaft of a motor vehicle utilizing the power switch of the present invention comprises a substantially cylindrical outer housing 10 secured to the steering shaft by a collar 12, an inner tubular body 14 positioned in the outer housing 10 and a cylinder lock 16 located in the inner tubular body 14. The cylinder lock 16, which is of a known type, comprises a stationary cylinder 18 and a rotating cylinder 20 which can be actuated by a key 22. Secured to the rotating cylinder 20 is a rotor 24 having a helical cam operating in cooperation with a cam follower 26. The cam follower 26 is carried by an axially slidable rod 28 connected to a latch 30. Latch 30, which is slidable in the direction parallel to the axis of the cylinder lock 16, prevents rotation of the steering shaft and, to this effect, is subject to the action of a helical spring 32 which presses the latch downward into its locking position.

The motor vehicle power switch 34 is generally shown positioned in the housing 10. Switch 34, shown in greater detail in FIGS. 2–11, essentially comprises a stator 36 and a movable member 38 inserted into a substantially semi-cylindrical housing 40, the axis of which is parallel to the axis of the outer housing 10.

Stator 36 comprises a body 37 made of an insulating material. The body 37 is secured to the flat inner side wall of the semi-cylindrical housing 40 and has an outer radial plate 42 at one end for fixing switch 34 inside of the antitheft device. A main fixed contact 44 and four secondary fixed contacts 46*a*, 46*b*, 46*c* and 46*d* project from the side of the insulating body 37 directed toward the curved surface of the housing 40. The main fixed contact 44 consists of an electrically conducting strip located in a plane parallel to the axis of the device and secured to the central part of insulating body 37 by a rivet 48. Rivet 48 extends through a corresponding hole in the insulating body 37 and is connected to a small conducting plate 50 at its inner end. A clamp 52 is secured to the conducting plate 50 to provide a connection between the conducting strip 44 and a conductor 54 which is connected to the vehicle's power source.

The secondary fixed contacts 46*a*, 46*b*, 46*c*, 46*d* are positioned in pairs on both sides of the conducting strip 44. Each of the secondary fixed contacts 46*a*, 46*b*, 46*c*, 46*d* comprises a rivet which extends through a corresponding hole in the insulating body 37 and which is connected to a small conducting plate 56*a*, 56*b*, 56*c*, 56*d*. Each of the conducting plates 56*a*, 56*b*, 56*c*, 56*d* is fixed to a clamp 58*a*, 58*b*, 58*c*, 58*d* providing a connection between the respective secondary fixed contacts and electrical conductors 60*a*, 60*b*, 60*c*, 60*d*. Conductors 60*a*, 60*b*, 60*c*, 60*d* are respectively connected to the coil or bobbin, the service mechanism, the fuel pump and the starter of the motor vehicle.

The insulating body 37 and the conducting strip 44 are provided with respective projections 62,64 directed towards the curved surface of the housing 40. The function of these projections will be described in detail in the following portions of the specification. Projections 64 and 64 are joined respectively to the insulating body 37 and to the conducting strip 44, by means of sharply inclined surfaces 62*a*, 64*a* (FIGS. 10 and 11).

The movable member or slider 38 is made of an insulating material slidably guided in the area between the stator 36 and the curved side wall of the housing 40. As seen in FIG. 1, an appendage 66 is provided at the end of slider 38 and directed towards the rotor 24. The appendage 66 extends outside the housing 40 and is slidably inserted in a helical groove 68 positioned in the side wall of rotor 24. In this manner, when the movable cylinder 20 of lock 16 is rotated, rotation of the rotor 24 occurs causing movement of the slider 38 along the axis of the device.

Figure 9:
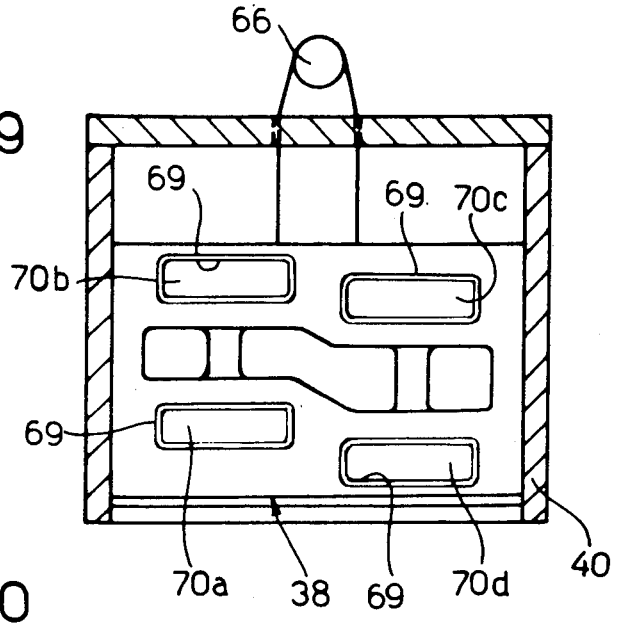
FIG. 9 is a longitudinal section along the line IX—IX of FIG. 5.

As shown in FIG. 9, the slider 38 has four quadrangular recesses 69 facing the fixed member 36 in each of which is mounted a rotating roller 70*a*, 70*b*, 70*c*, 70*d* made of an electrically conducting material. The axis of the conducting rollers is perpendicular to the movement of slider 38 and the axial length of the rollers is greater than the distance between the contacting strip 44 and the fixed secondary contacts 46*a*, 46*b*, 46*c*, 46*d* of the stationary member 36. Each conducting roller 70*a*, 70*b*, 70*c*, 70*d* is subjected to the action of a helical spring 72, partially inserted in an annular cavity 74 of the slider 38 and aligned with the central area of a corresponding quadrangular recess 69. The helical spring 72 acts on the central areas of the respective conducting rollers 70*a*, 70*b*, 70*c*, 70*d* so as to press the rollers against the stationary member 36 of switch 34. The rollers 70*a*, 70*b*, 70*c*, 70*d* are movable contacts which connect the secondary fixed contacts 46*a*, 46*b*, 46*c*, 46*d* to the main fixed contact 44 in a predetermined sequence as a result of movement by the slider 38 upon rotation of rotor 24.

Figure 10:
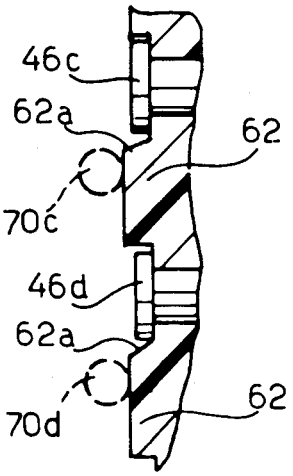
FIG. 10 is a longitudinal section along the line X—X of FIG. 6.
Figure 11:
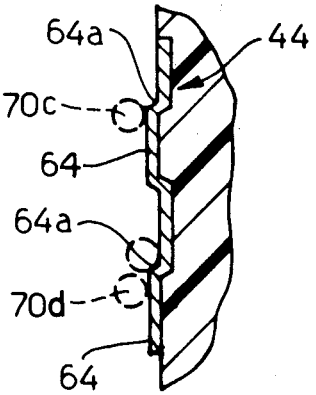
FIG. 11 is a longitudinal section along the line XI—XI of FIG. 6.

During movement of slider 38 with respect to the stator 38 of switch 34, each conducting roller follows a pathway comprising a raised section corresponding to the respective projections 62,64 and a lowered section (FIGS. 10 and 11). When positioned on projections 62,64, the roller is only in electric contact with the conducting strip 44. However, when positioned on the lower section, the roller electrically connects the conducting strip 44 with the corresponding secondary fixed contact. The passage of the roller from the raised section to the lowered section of its pathway is due to the inclined surface 62*a*,64*a* of the projections 62,64 which guarantees a quick closing of the contacts.

Due to rotation of rotor 24, switch 34 assumes three different successive positions corresponding respectively to a rest position, a driving or ignition position and a starting position. In the rest position, illustrated in FIGS. 3–11, slider 38 is in its lower position in which the rollers 70*a*, 70*b*, 70*c*, 70*d* are located on the raised sections of the respective pathways. Under these circumstances, all the fixed contacts of the stator 36 are open.

Figure 12:
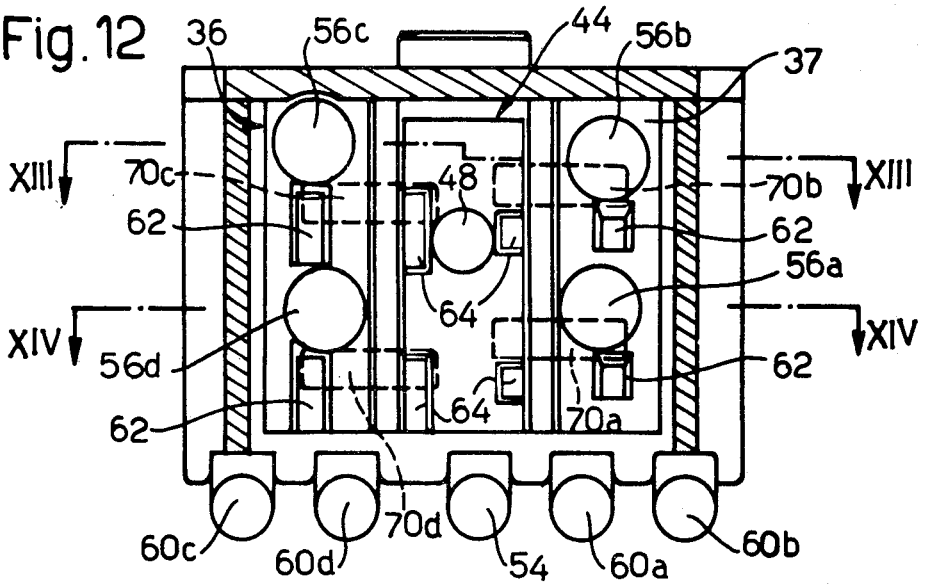
FIG. 12 is a sectional view similar to that of FIG. 6, showing the switch in a first operating position.
Figure 13:
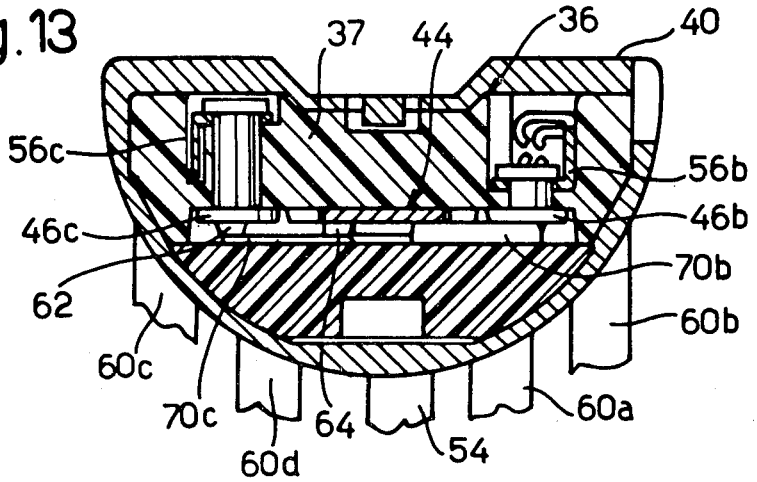
FIG. 13 is a cross section along the line XIII—XIII of FIG. 12.
Figure 14:
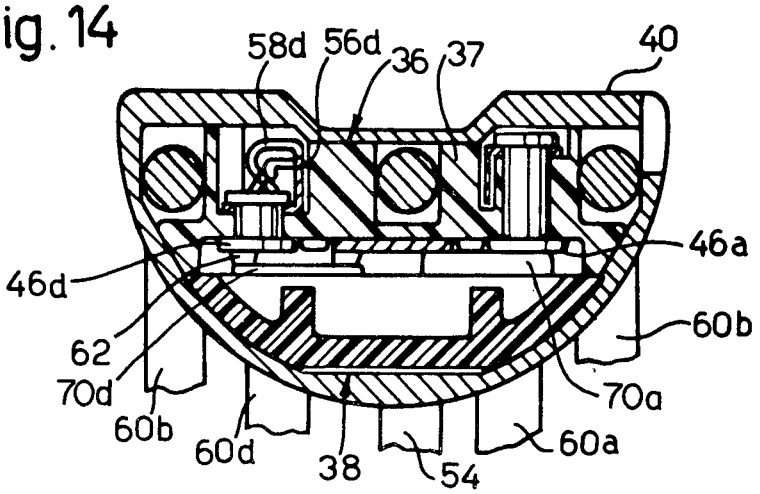
FIG. 14 is a cross section along the line XIV—XIV of FIG. 12.
Figure 15:
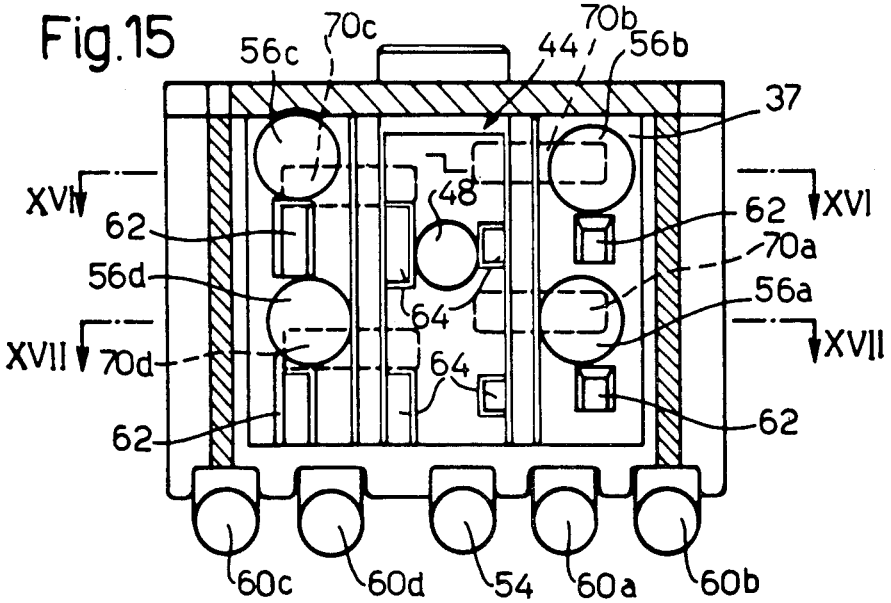
FIG. 15 is a sectional view similar to that of FIG. 6 showing the switch in a second operating position.
Figure 16:
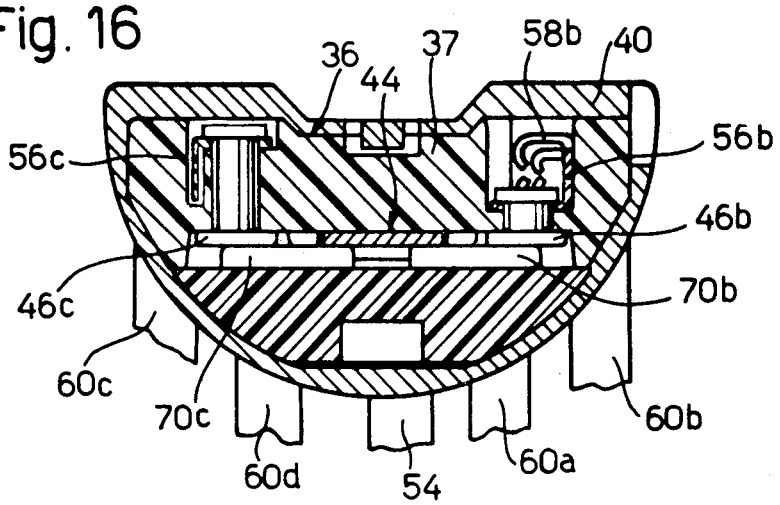
FIG. 16 is a cross section along the line XVI—XVI of FIG. 15.
Figure 17:
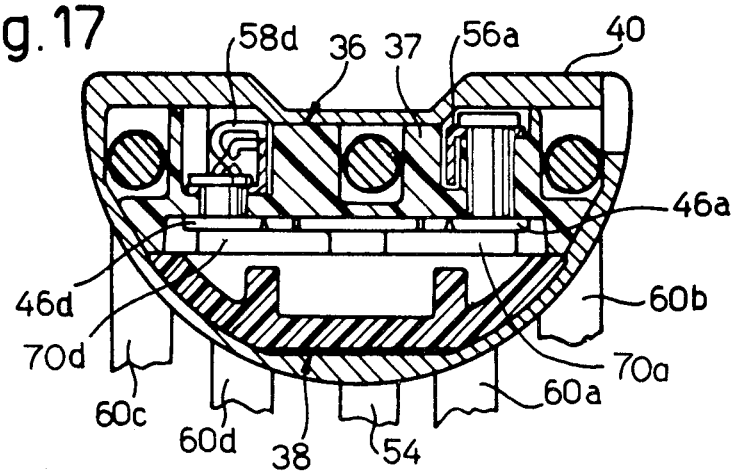
FIG. 17 is a cross section along the line XVII—XVII of FIG. 15.

In the ignition position shown in FIGS. 12–14, the slider 38 is in an intermediate raised position. In this position, the conducting rollers 70*c*, 70*d* are still located on the raised sections of their respective pathways because they are still in contact with the respective projections 62,64, whereas the conducting rollers 70*a*, 70*b* are located on the lower sections of their respective pathways. Under these circumstances, only the secondary fixed contacts 46*a*, 46*b* are electrically connected to the conducting strip 44. In the ignition position of the slider 38, the electrical current from the vehicle's power source therefore feeds only the coil and other service mechanisms of the vehicle.

In the starting position of the switch 34, shown in FIGS. 14–17, the slider 38 is in a completely raised position, in which the four rollers 70*a*, 70*b*, 70*c*, 70*d* are all positioned in the lower sections of their respective pathways. The current from the vehicle's power source now feeds the coil, other service mechanisms, the fuel pump and the starter of the vehicle. When the rotor 24 is rotated in the opposite direction, the switch 34 is brought back first to its ignition position and subsequently to its rest position.

It is to be understood that the invention is not limited to the exact construction shown and described, but that various changes and/or modifications may be made without departing from the spirit and scope of the invention as defined in the appended claims.

I claim:

1. A motor vehicle power switch assembly operable by a key-actuated cylinder which is rotatable between a first position and a second position, said assembly comprising:

a starter having a first fixed contact for connection with a power source and a plurality of second fixed contacts for connection with motor vehicle circuits to be energized by said power source;

a housing;

a slider positioned between said stator and an inner wall of said housing, said slider being movable axially with respect to said stator between a first position and a second position, said slider, when operatively connected to the key actuated cylinder, being moved from the first to the second position when the cylinder is rotated from the first position to the second position;

a plurality of conductive rollers carried by said slider, each of said rollers being positioned so that it is moved into alignment to make an electrical connection between said first fixed contact and an associated one of said second fixed contacts as said slider moves from its first to its second position; and means resiliently urging each of said rollers toward said stator and, when aligned with one of said second fixed contacts toward an electrical connection between one of said second fixed contacts and said first fixed contact.

2. The motor vehicle power switch of claim 1 further including means on said stator operable, when said slider is in an axial position where one of said rollers is not aligned to make an electrical connection between said first fixed contact and one of said second fixed contacts, to urge said roller away from said stator, but inoperable, when said slider is in an axial position where said roller is aligned to make the electrical connection, to keep said roller away from the associated one of said second fixed contacts.

3. The motor vehicle power switch of claim 2 wherein said means on said stator comprises raised and lower stator surfaces which are substantially parallel and surfaces therebetween which are sharply inclined with respect thereto.

4. The motor vehicle power switch of claim 1 wherein said rollers are resiliently urged toward said stator by a plurality of helical springs secured to said slider.

5. The motor vehicle power switch of claim 1 wherein said stator comprises an insulating body, said first fixed contact comprises an electrically conductive strip secured to said insulating body, and said second fixed contacts are secured to said insulating body and positioned on both sides of said electrically conductive strip.

6. The motor vehicle power switch of claim 5 wherein said first fixed contact further includes a conductive plate, a clamp secured to said conductive plate for electrical connection with the power source and a conductive rivet which extends through a hole in said insulating body and secures said electrically conductive strip and said first conductive plate to opposite sides of said insulating body.

7. The motor vehicle power switch of claim 5 further including a clamp for electrical connection with each of the motor vehicle circuits, a second conductive plate and an electrically conductive rivet for each clamp, wherein each rivet extends through a hole in the insulating body, one end of each rivet comprises a second fixed contact, the other end of each rivet secures one of said second conductive plates to said insulating body, and each clamp is secured to one of said second conductive plates.

* * * * *

UNITED STATES PATENT AND TRADEMARK OFFICE

CERTIFICATE OF CORRECTION

PATENT NO. : 4,360,717

DATED : November 23, 1982

INVENTOR(S) : Guiseppe Maiocco

It is certified that error appears in the above-identified patent and that said Letters Patent are hereby corrected as shown below:

Column 4, line 53, substitute -- stator -- for "starter"

Signed and Sealed this

*Sixteenth* Day of *August 1983*

[SEAL]

*Attest:*

GERALD J. MOSSINGHOFF

*Attesting Officer*

*Commissioner of Patents and Trademarks*